United States Patent [19]

Dilley

[11] 4,201,988

[45] May 6, 1980

[54] WIDEBAND VHF ANTENNA

[75] Inventor: Douglas M. Dilley, La Mesa, Calif.

[73] Assignee: The United States of America as represented by the Secretary of the Navy, Washington, D.C.

[21] Appl. No.: 17,749

[22] Filed: Mar. 5, 1979

[51] Int. Cl.[2] ..... H01Q 1/32

[52] U.S. Cl. ..... 343/715; 343/908

[58] Field of Search ..... 343/752, 722, 802, 895, 343/848, 908, 749, 745, 845, 715

[56] References Cited

U.S. PATENT DOCUMENTS

| | | | |
|---|---|---|---|
| 2,971,192 | 2/1961 | Clifford et al. | 343/749 |
| 3,103,011 | 9/1963 | Seeley | 343/749 |
| 3,594,810 | 3/1970 | Kaloi | 343/895 |
| 3,631,499 | 12/1971 | Turner | 343/701 |
| 3,699,452 | 10/1972 | Lindenmeier et al. | 343/895 |
| 3,825,933 | 7/1974 | Debski et al. | 343/895 |
| 4,101,898 | 7/1978 | Ingram | 343/895 |

*Primary Examiner*—David K. Moore

*Attorney, Agent, or Firm*—R. S. Sciascia; G. J. Rubens; H. Fendelman

[57] ABSTRACT

A wideband VHF antenna operable simultaneously on multiple frequencies having an instantaneous bandwidth greater than one octave and having a total length less than one-quarter wavelength at the lowest operating frequency. A wideband impedance transformer is connected to the antenna total radiating structure at the feed point. The radiating structure comprises a conductor secured to a dielectric whip. The conductor is comprised of two sections of length L1 connected by a short length of electrical connector to form a large loop. The radiating structure further comprises a second electrical conductor of length L2 connected by another short length of electrical connector so as to form a small loop. The length L2 conductor is disposed in the neutral plane between the two conductor sections of length L1.

16 Claims, 3 Drawing Figures

WIDEBAND VHF ANTENNA

BACKGROUND OF THE INVENTION

The present invention relates to the electromagnetic antenna art and particularly to the art of antennas that are electrically small, as well as being operational over a wide bandwidth and on several frequencies within the bandwidth at the same time without adjustment. A long standing and continuing goal in the antenna art has been, and is, to provide effective antennas that require the least amount of physical space. A small single antenna that will operate effectively over a relatively broadband of frequencies is highly desirable with any variable frequency or tunable transmitter or receiver system. For instance it is very beneficial to military vehicles whether they be airplanes, tanks, or submarines to have the smallest number and smallest size antennas that are feasible to maintain effective communication.

VHF antennas currently in use on U.S. military vehicles have the disadvantage of being over ten feet high and 0.75 inches thick. They thus present stowage problems, are visible to the enemy at considerable distances and frequently encounter obstacles which transmit damaging shocks to the antenna base and mounting structure. Further, these antennas have an electromechanical tuner built into the base consisting of coils, capacitors, rotary switch mechanisms, and a stepping motor, all subject to failure because of moving parts and corrosion when the base housing leaks. The RC-292, mast mounted VHF antenna, is currently in use by the military for land-based, fixed portable applications. This antenna has the disadvantages of being heavy, having rigid ground plane elements making it cumbersome to erect, and having elements which must be changed twice in order for it to be operated throughout the frequency range of 30–76 MHz. Other military broadband antennas having multiple frequency capability have the disadvantages of being extremely high vertically and of having threaded sections that are subject to loosening in vibration and requiring a base spring which is RF "hot", thus subjecting the antenna to shorting to ground by salt spray in amphibious vehicle applications.

SUMMARY OF THE INVENTION

The present invention is a wideband vertical whip antenna for mobile and portable radio applications. The antenna has an instantaneous bandwidth of more than an octave and allows operation on several frequencies within its bandwidth at the same time. The antenna of the present invention uses integrated compensation in the radiating element to achieve a 3:1 or better standing wave ratio over most of the band 30 through 76 MHz without auxiliary electromechanical tuners or lumped-constant reactances in the base.

Electrically the antenna consists of a 4:1 wideband impedance transformer and a double stub compensated radiating element. The radiating structure of the present antenna is formed on a vertical dielectric whip such that it comprises a short stub formed by a small loop at the lower end of the antenna and a long stub formed by a main loop at the top of the antenna. The short stub formed by the small loop effectively lengthens the antenna on lower frequencies and divorces the lower section of the antenna at the higher frequencies. The long stub formed on the main loop broadens the frequency response at the middle frequencies.

The integrated compensation antenna of the present invention thus accomplishes wide instantaneous bandwidth in a short vertical whip antenna. The alternatives to the integrated compensation technique utilized in the present invention are capacitive loading, lumped LC elements or coaxial compensation stubs connected at the antenna feed point. Any of these alternatives requires considerably more space and weighs more than the integrated stubs used in the present invention. The alternatives further involve a separate fabrication and adjustment operation which increases their final production costs. Also, non-integrated compensation antennas have a history of low reliability because of the difficulty in isolating these elements from the effects of moisture, shock and vibration. Furthermore, such alternatives have an undesirable physical size to power handling capability ratio.

The wideband antenna of the present invention has the primary advantage of being relatively short and thin. As such, it needs no base spring and is invisible to the unaided eye against a foliage background at 500 yards. Because it contains no moving parts, its base may be potted, allowing the entire radiating and matching structure to be insulated and protected from shorting and corrosion from salt water. The antenna is of simple construction from common materials. Thus, it may be produced in quantity at a low cost per unit.

The antenna of the present invention has a large instantaneous bandwidth with reasonable radiating efficiency in a whip-like configuration which is short compared to an electrical quarter wavelength at the lowest operating frequency. The antenna also includes close integration of radiating and compensating elements in a single structure of low profile. The specific choice of element lengths and compensation line orientation utilized in the present invention enables it to establish independent standing wave modes.

OBJECTS OF THE INVENTION

Accordingly, it is the primary object of the present invention to disclose a novel vertical wideband ship antenna that allows multiple frequency operation in a single radiating structure without adjustment.

It is a further object of the present invention to disclose a reduced Q antenna structure implemented in a small, flexible, whip-type antenna structure by the use of compensating elements.

It is an additional object of the present invention to disclose an antenna structure with inherent high power capabilities that retains small size and weight.

Other objects, advantages and novel features of the invention will become apparent from the following detailed description of the invention when considered in conjunction with the accompanying drawings.

DESCRIPTION OF THE PREFERRED EMBODIMENT

Figure 1:
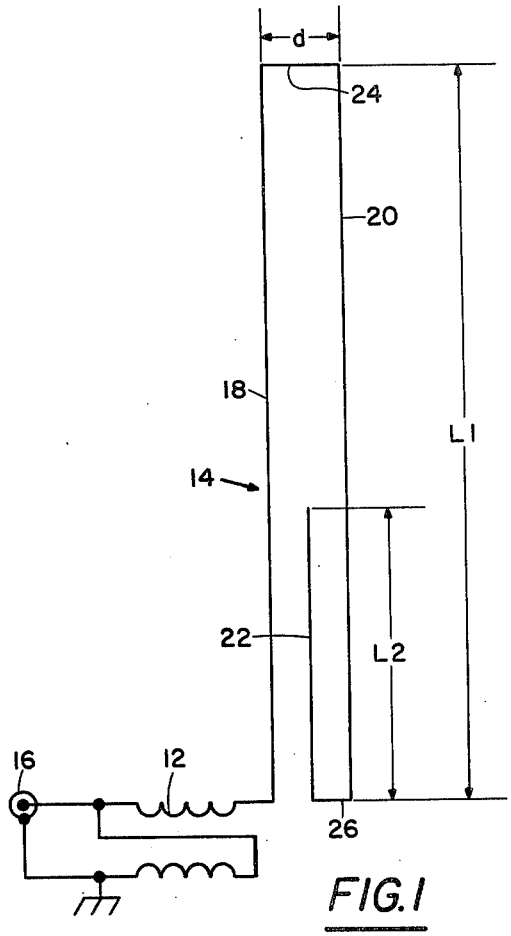
FIG. 1 is an electrical schematic diagram of the VHF antenna of the present invention.

Referring to FIG. 1, the wideband VHF antenna of the present invention is seen to comprise a 4:1 wideband impedance transformer 12 and a double stub compensated radiating element 14. The wideband transformer 12 is preferably a broadband toroidal core type transformer. The input to the antenna structure is nominally 50 ohms via a BNC type coaxial connector 16 at the base mounting plate (not shown). The double stub compensated radiating element 14 is further comprised of a first conductor 18 of length L1, a second conductor 20 of length L1 and a third conductor 22 of length L2. The conductors 18 and 20 are connected by a connecting wire 24 and the conductors 20 and 22 are connected by a connecting wire 26. The transformer 12 is grounded as illustrated.

Figure 3:
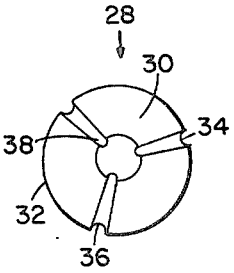
FIG. 3 is a top view of the whip section of the antenna of the present invention.
Figure 2:
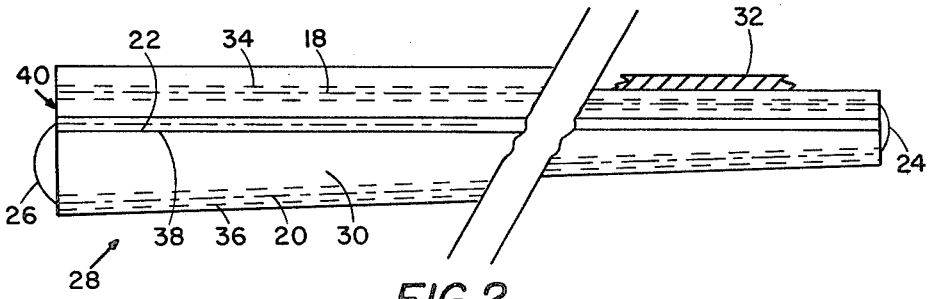
FIG. 2 is a cut-away view of the whip section of the present invention.

Referring now to the cutaway view of the whip section of the antenna in FIG. 2 and FIG. 3 there is illustrated the dielectric antenna whip 28 which consists of a tapered core 30 and an outer jacket of fiberglass 32 which extends along the length of the core 30 but is illustrated in segmented portion only for purposes of simplicity. The core material for the whip 28 is preferably single off-center ground extruded fiberglass. Three equispaced slots 34, 36 and 38 are broached into the core to receive the conductors 18, 20 and 22 which preferably are braided conductors. Although the electrical connectors 24 and 26 are illustrated as being external to the core 30, it is to be understood that the connectors 24 and 26 may be imbedded in the core 30 by providing slots in the core such that the connectors 24 and 26 may be countersunk. To form the jacket 32, an outer layer of impregnated fiberglass cloth is wrapped around the antenna whip after the conductors 18, 20 and 22 and the connectors 24 and 26 are afixed thereto. The assembled whip section 28 may then be cured and given a weatherproof coating of epoxy paint.

In the preferred embodiment the conductors 18 and 20 are each seventy-one inches long and the conductor 22 has a length L2 of approximately twenty-nine inches. The antenna whip 28 has approximately a 3/16-inch diameter at the top end and approximately a ⅜-inch diameter at the base 40.

The conductors 18, 20 and 22 as well as the connectors 24 and 26 are configured to provide a radiating structure which has several electrical resonances which are not harmonically related in the frequency range 30–76 MHz. Since each electrical resonance in the structure corresponds to a unique drive point impedance, parts of the structure function as impedance transformers and the best compromise drive impedance is transformed by the toroidal transformer 12 to a nominal 50 ohms in the preferred embodiment. It is important to note that by orienting the conductors 18, 20 and 22 at equidistant intervals around the fiberglass whip 28, i.e. spatially oriented at 120° intervals, the conductor 22 is positioned so as to lie in the neutral plane between the conductors 18 and 20. Because the conductor 22 lies in the neutral plane between the conductors 18 and 20, balanced currents in conductors 18 and 20 will not induce current in the conductor 22 and current in the conductor 22 will not induce balanced currents in the conductors 18 and 20.

The electrical resonances which are not harmonically related which may exist in the antenna of the present invention, in the order of increasing frequency are as follows: (1) the quarter wave resonance formed of the capacitance of the total radiating structure 14 and the self-impedance of the transformer 12, i.e. the reactance of the non-ideal transformer 12 at the lower frequencies resonates with the capacitance of the structure 14 at a frequency below the quarter wave resonance; (2) the quarter wave resonance of the standing wave on the total length 2L1+L2; this is attributable to the fact that at the higher frequency the transformer 12 acts more like an ideal transformer; (3) the quarter wave resonance of the basic element 18 of length L1; (4) the three-quarter wave resonance of the total length 2L1−L2; (5) there is also a ⅜ wave resonance over the length 2L1. There are, of course, ½ wave resonances in the structure but these are close to other quarter wave modes which dominate. The half-wave modes are important in that they provide some reactive compensation, behaving as stubs. Most important of these is the reactive component contributed by the shorted stub formed of the two elements 18 and 20 when the resonance near quarter wave at the length L1 is considered. An additional degree of freedom may be provided if the element 22 is folded over, still in the neutral plane, to form a second loop. Several other degrees of freedom may be found but are not discussed herein.

For proper operation, the antenna of the present invention is assumed to be working against a suitable ground plane. The physical dimensions of importance are the lengths L1 and L2 and the ratio of the conductor separation d to conductor diameter. Length L1 is selected to be an approximate electrical wavelength about 25% above the lowest operating frequency. Best performance has been achieved when the length L2 is slightly less than half the length L1.

Obviously many modifications and variations of the present invention are possible in the light of the above teachings. It is therefore to be understood that within the scope of the appended claims the invention may be practiced otherwise than as specifically described.

What is claimed is:

1. A wideband VHF antenna operable simultaneously on multiple frequencies comprising:

an elongated dielectric antenna whip having first and second ends;

a first electric conductor of length L1 secured to said dielectric whip and extending substantially along the entire length thereof;

a second electric conductor of length L1 secured to said dielectric whip and extending substantially along the entire length thereof;

a first electric connector connecting said first electric conductor to said second electric conductor;

a third electric conductor of length L2 secured to said dielectric antenna whip and disposed in the neutral plane between said first and second electric conductors;

a second electric connector connecting said second electric conductor to said third electric conductor; and a wideband transformer connected to said first electric conductor.

2. The antenna of claim 1 wherein L2 is less than L1.

3. The antenna of claim 1 wherein said first, second and third electric conductors are spatially oriented 120° apart.

4. The antenna of claim 1 wherein said first, second and third electric conductors, said first and second connectors and said elongated dielectric whip comprise the total radiating structure.

5. The antenna of claim 4 wherein said first electric connector connects said first electric conductor to said second electric conductor at said first end and said second electric connector connects said second electric conductor to said third electric conductor at said second end.

6. The antenna of claim 4 wherein said antenna resonates at the quarter wave resonance frequency formed of the capacitance of said total radiating structure and the self-impedance of said transformer.

7. The antenna of claim 4 wherein said antenna resonates at the quarter wave resonance of the standing wave on the total length of said antenna 2(L1)+L2.

8. The antenna of claim 4 wherein said antenna resonates at the quarter wave resonance of said first electric conductor.

9. The antenna of claim 4 wherein said antenna resonates at the $\frac{3}{4}$ wave resonance of the total length 2(L1)−L2.

10. The antenna of claim 4 wherein said antenna radiates at the $\frac{3}{8}$ wave resonance of the total length 2(L1).

11. A wideband VHF antenna comprising:

an elongated dielectric whip;

first and second electric conductors each of length L1 secured to said dielectric whip, extending along the length thereof;

a first electric connector connecting said first and second electric conductors and forming therewith a large loop;

a third electric conductor secured to said dielectric whip in the neutral plane between said first and second electric conductors;

a second electric connector connecting said second electric conductor to said third electric conductor and forming therewith a small loop; and a wideband transformer connected to said first electric conductor.

12. An antenna comprising:

means for radiating and receiving electromagnetic energy over a continuous band of frequencies including at least an octave said means comprising an elongated dielectric whip;

first and second electric conductors each of length L1 secured to said dielectric whip, extending along the length thereof;

a first electric connector connecting said first and second electric conductors and forming therewith a large loop;

a third electric conductor secured to said dielectric whip in the neutral plane between said first and second electric conductors;

a second electric connector connecting said second electric conductor to said third electric conductor and forming therewith a small loop; and a wideband transformer connected to said first electric conductor.

13. The antenna of claim 12 wherein said continuous band of frequencies is the 30 MHz to 76 MHz band.

14. The antenna of claim 1 wherein said antenna whip has a mean diameter that is approximately 1/200 of said length L1.

15. The antenna of claim 1 wherein said elongated dielectric antenna whip has a generally circular cross section.

16. The antenna of claim 1 wherein said length L1 is less than one-quarter wavelength at the lowest operating frequency of said antenna.

* * * * *